US011793240B2

(12) United States Patent
Liu

(10) Patent No.: US 11,793,240 B2
(45) **Date of Patent: *Oct. 24, 2023**

(54) HEATING HANDLE

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 377 days.

This patent is subject to a terminal disclaimer.

(21) Appl. No.: 17/124,432

(22) Filed: Dec. 16, 2020

(65) Prior Publication Data

US 2022/0061392 A1 Mar. 3, 2022

(30) Foreign Application Priority Data

Aug. 25, 2020 (CN) ..... 202010863461.7
Aug. 25, 2020 (CN) ..... 202021795439.5

(51) Int. Cl.

| | |
|---|---|
| ***A24F 40/465*** | (2020.01) |
| ***A24F 40/485*** | (2020.01) |
| ***A24F 40/20*** | (2020.01) |
| ***A24F 40/42*** | (2020.01) |
| ***A24F 40/60*** | (2020.01) |
| ***A24F 1/30*** | (2006.01) |
| ***A24F 5/00*** | (2006.01) |
| ***A24F 40/46*** | (2020.01) |

(52) U.S. Cl.

CPC ..... *A24F 40/465* (2020.01); *A24F 1/30* (2013.01); *A24F 5/00* (2013.01); *A24F 40/20* (2020.01); *A24F 40/42* (2020.01); *A24F 40/46* (2020.01); *A24F 40/485* (2020.01); *A24F 40/60* (2020.01)

(58) Field of Classification Search

CPC .... A24F 1/30; A24F 5/00; A24F 40/20; A24F 40/42; A24F 40/60; A24F 40/465; A24F 40/485

See application file for complete search history.

(56) References Cited

U.S. PATENT DOCUMENTS

2017/0251718 A1* 9/2017 Armoush et al. ..... A24F 1/30

* cited by examiner

*Primary Examiner* — Michael J Felton
*Assistant Examiner* — Ronnie Kirby Jordan
(74) *Attorney, Agent, or Firm* — MATTHIAS SCHOLL P.C.; Matthias Scholl

(57) ABSTRACT

A heating handle includes a housing and a magnetic induction coil. The housing is L-shaped and includes a through hole, and the magnetic induction coil is disposed in the through hole.

5 Claims, 4 Drawing Sheets

HEATING HANDLE

CROSS-REFERENCE TO RELATED APPLICATIONS

Pursuant to 35 U.S.C. § 119 and the Paris Convention Treaty, this application claims foreign priority to Chinese Patent Application No. 202010863461.7 filed on Aug. 25, 2020, and to Chinese Patent Application No. 202021795439.5 filed on Aug. 25, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a heating handle.

Conventionally, when a heating handle is combined with a hookah for heating a tobacco material, the heating handle is held by users to heat the tobacco material in the hookah, which is inconvenient.

SUMMARY

The disclosure provides a heating handle, comprising a housing and a magnetic induction coil; the housing is L-shaped and comprises a through hole, and the magnetic induction coil is disposed in the through hole.

In a class of this embodiment, the heating handle further comprises a heat insulation cup disposed in the magnetic induction coil to protect the magnetic induction coil.

In a class of this embodiment, the heating handle further comprises a container for accommodating a tobacco material; the diameter of the container is the same as that of the through hole; the container is disposed in the through hole and matches the magnetic induction coil; and the container is a metal, or a part of the container is a metal, or the container is a nonmetal comprising an inlaid metal.

In a class of this embodiment, the heating handle further comprises a nozzle disposed on a top end of the container; the nozzle comprises an air passage; a sectional area of the air passage is variable by partly covering an opening of the nozzle with fingers, so as to control an amount of vapor.

The disclosure also provides an electronic hookah, comprising the heating handle and a smoke filter; when in use, vapor produced in the heating handle is filtered in the smoke filter for user's inhaling.

DETAILED DESCRIPTION

To further illustrate, embodiments detailing a heating handle are described below. It should be noted that the following embodiments are intended to describe and not to limit the disclosure.

Principle of high frequency heating: when an alternating current is introduced to a magnetic induction coil, an alternating magnetic field will be generated. When a metal conductor is placed in the alternating magnetic field, an eddy current is produced. The eddy current makes the metal conductor heated.

Tobacco materials refer to tobacco tar, tobacco paste, tobacco leaf and other materials used to produce smoke.

Figure 1:
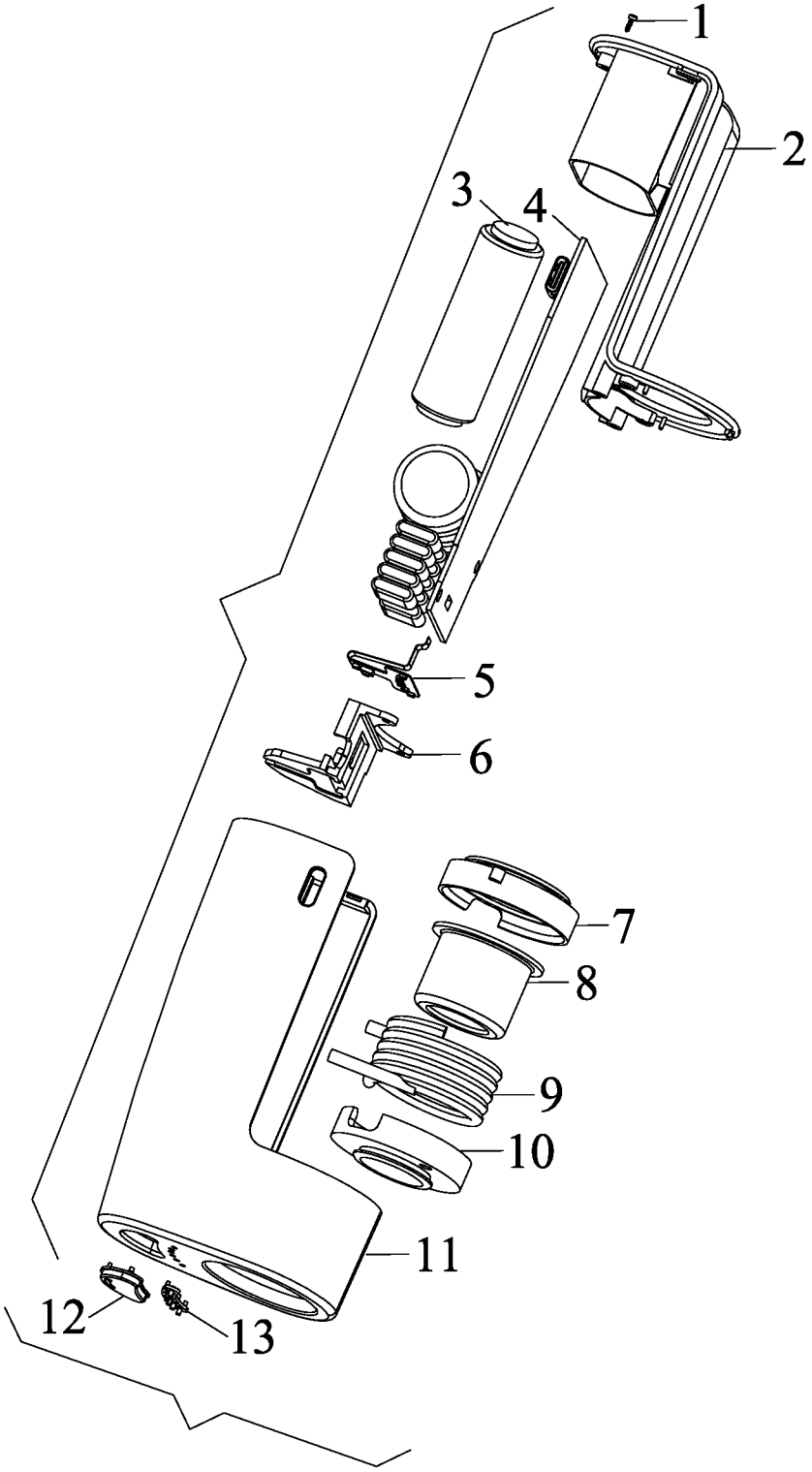
FIG. 1 is an exploded view of a heating handle in accordance with one embodiment of the disclosure.
Figure 2:
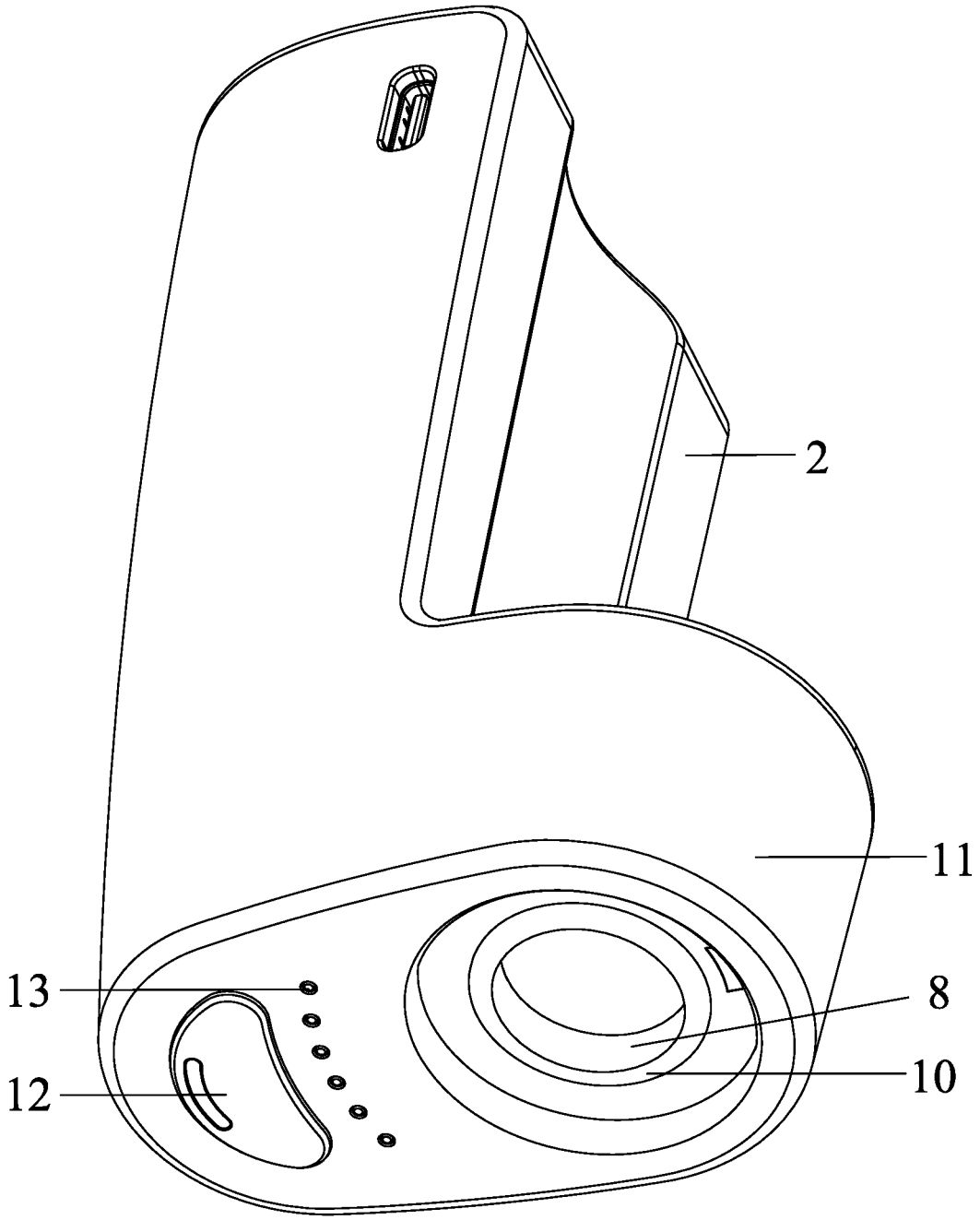
FIG. 2 is a schematic diagram of a heating handle in accordance with one embodiment of the disclosure.
Figure 3:
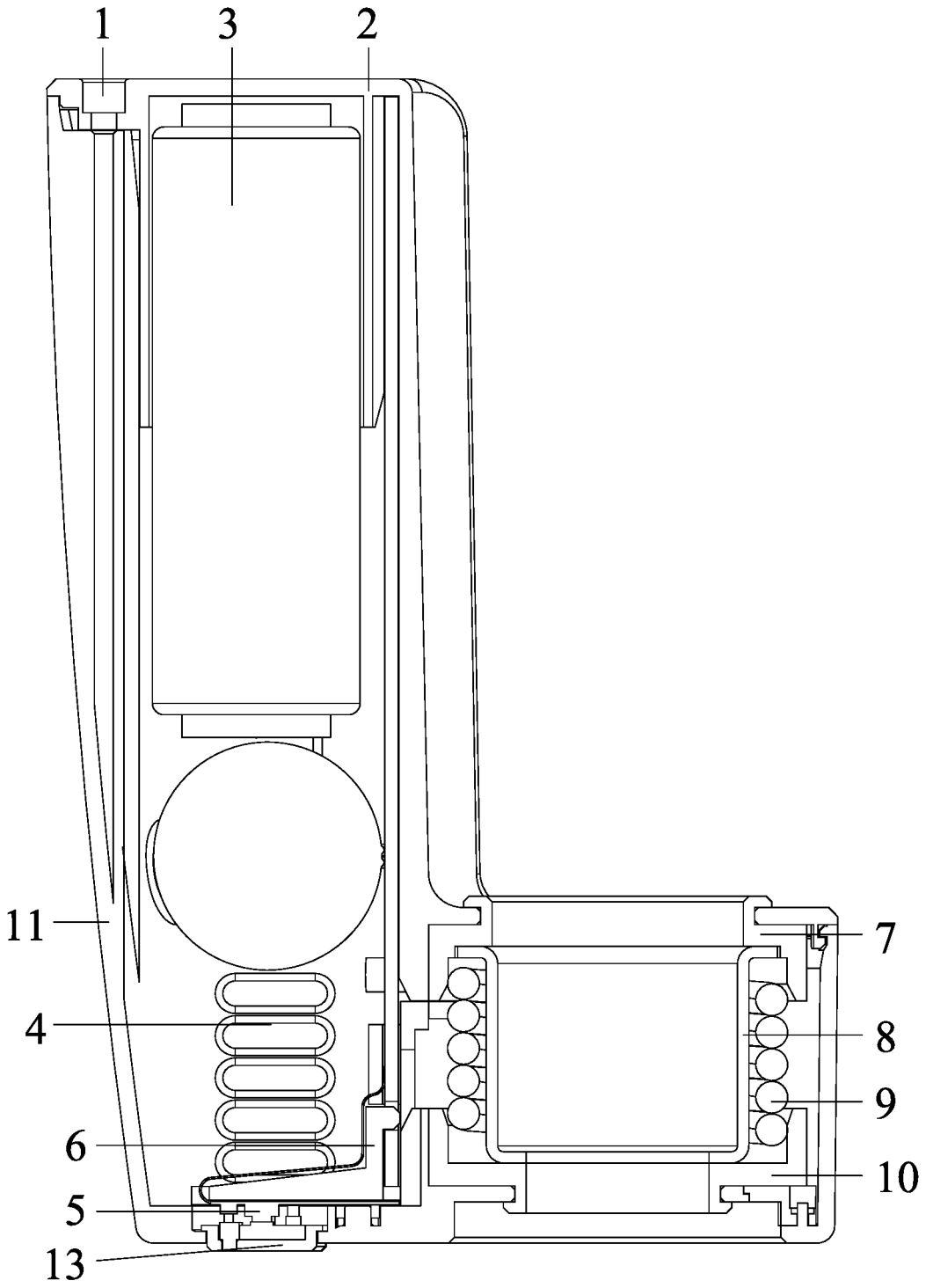
FIG. 3 is a sectional view of a heating handle in accordance with one embodiment of the disclosure.

As shown in FIGS. 1-3, the disclosure provides a high frequency heating handle comprising a screw 1, an end cover 2, a battery 3, a variable frequency power supply 4, a key board 5, a support 6, a silicone positioner 7, a heat insulation cup 8, a magnetic induction coil 9, a silicone heat insulator 10, a housing 11, a power button 12, and a lamp post 13. The heat insulation cup 8 is disposed in the magnetic induction coil 9 to protect the magnetic induction coil 9. The silicone heat insulator 10 is disposed on the bottom end of the magnetic induction coil 9 for thermal insulation. The output end of the variable frequency power supply 4 is soldered on the input end of the magnetic induction coil 9 to supply alternating current to the magnetic induction coil 9, and the magnetic induction coil 9 is disposed in the housing 11. The silicone positioner 7 is disposed on the top end of the magnetic induction coil 9 to position the magnetic induction coil 9 on the bottom of the housing 11. The housing 11 is L-shaped. The output end of the battery 3 is connected to the input end of the variable frequency power supply 4. The output end of the variable frequency power supply 4 is soldered on the magnetic induction coil 9. When the variable frequency power supply 4 outputs an alternating current passing through the magnetic induction coil 9, an induced magnetic field is produced. The key board 5 is disposed on the switching circuit of the variable frequency power supply 4 and fixed on the support 6. The variable frequency power supply 4 is fixed in the housing 11. The housing comprises a bottom end face comprising a first groove and a second groove. The power button 12 is disposed in the first groove and directly contacts a switch of the key board 5 so that when the power button 12 is pressed, the variable frequency power supply 4 is powered up to work. The lamp post 13 is fixed in the second groove. The end cover 2 is fixed on the housing by the screw 1.

Figure 4:
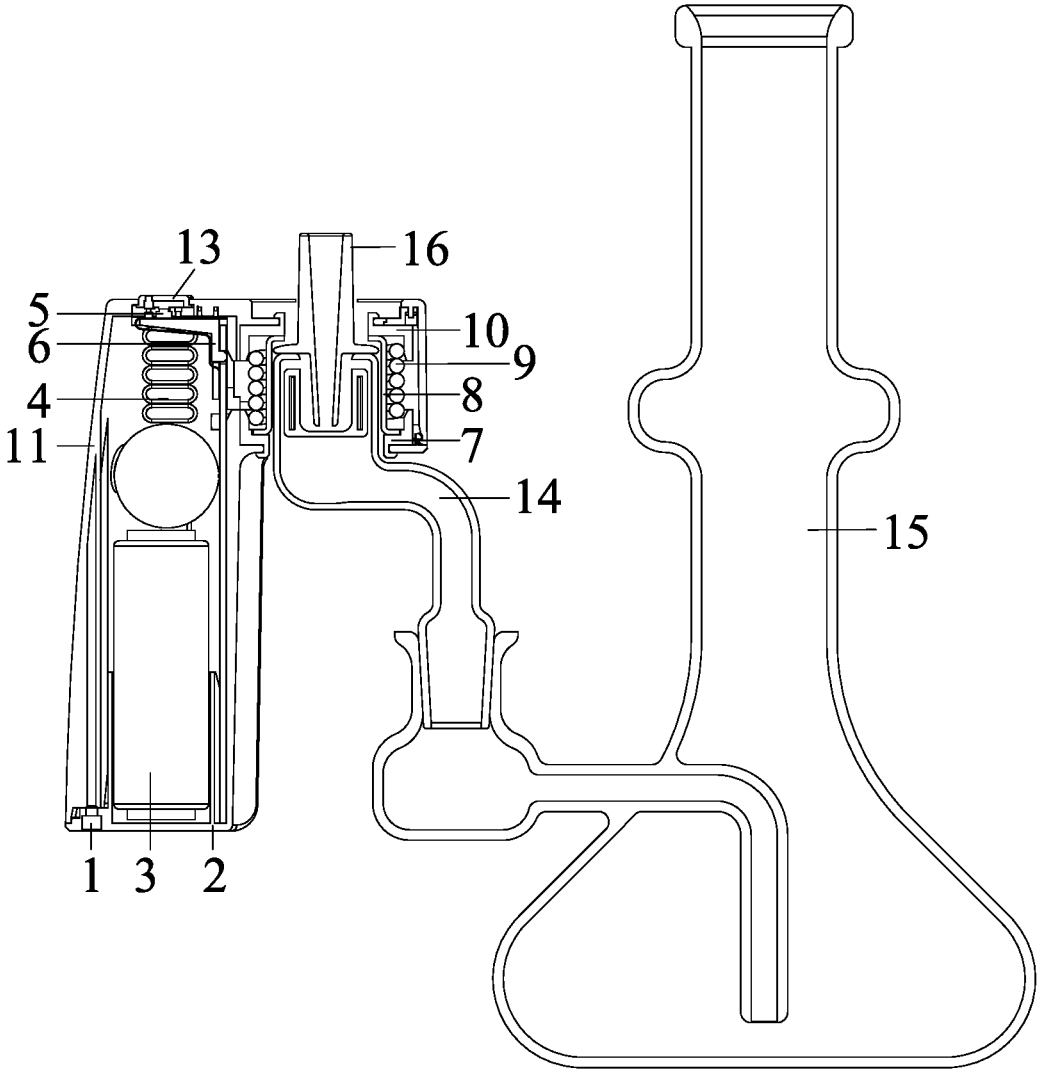
FIG. 4 shows a combination of a heating handle in accordance with one embodiment of the disclosure and a smoke filter.

As shown in FIG. 4, in one embodiment, the heating handle is combined with a hookah for heating a tobacco material. The hookah comprises a container 14 and a nozzle 16. The container is configured to accommodate the tobacco material. The heating handle comprises a through hole and the container 14 is clamped in the through hole. The nozzle 16 is disposed on the top end of the container 16 container 14 for air admission. The container 14 comprises an inlaid metal conductor. In the power on state, an eddy current is produced in the metal conductor in the induction magnetic field of the magnetic induction coil 9 whereby the metal conductor is heated up, and then the heated is transferred to the container 14 through heat transfer to heat the tobacco material in the container 14 to produce smoke. In the smoking process, the air enters the container 14 via the nozzle 16 and drives the smoke produced in the container 14 to enter the smoke filter 15 where the smoke is filtered by water and then flows out of the exit of the smoke filter for user's inhaling.

In another embodiment, the heating handle comprises the container for accommodating a tobacco material and the nozzle for air admission.

Optionally, besides a hookah comprising a smoke filter, the heating handle of the disclosure can be used in combination with other electronic cigarettes.

The following advantages are associated with the heating handle of the disclosure:

1. The heating handle is independent from the container and is connected to the container when in use, so the produced smoke does not flow to the heating handle, which is environmentally friendly.

2. The heating handle is independent from the container, so it is easy to carry.

3. When in use, the heating handle is directly fixed on the container to heat the tobacco material in the container, without the aid of users' hands, which is convenient for users to operate.

It will be obvious to those skilled in the art that changes and modifications may be made, and therefore, the aim in the appended claims is to cover all such changes and modifications.

What is claimed is:

1. A heating handle, comprising a housing and a magnetic induction coil; wherein the housing is L-shaped and comprises a through hole, and the magnetic induction coil is disposed in the through hole.

2. The heating handle of claim 1, further comprising a heat insulation cup disposed in the magnetic induction coil to protect the magnetic induction coil.

3. The heating handle of claim 2, further comprising a container for accommodating a tobacco material, wherein a diameter of the container is the same as that of the through hole; the container is disposed in the through hole and matches the magnetic induction coil; and the container is a metal, or a part of the container is a metal, or the container is a nonmetal comprising an inlaid metal.

4. The heating handle of claim 3, further comprising a nozzle disposed on a top end of the container; wherein the nozzle comprises an air passage; a sectional area of the air passage is variable by partly covering an opening of the nozzle with fingers, so as to control an amount of vapor.

5. An electronic hookah, comprising the heating handle of claim 1 and a smoke filter; wherein when in use, vapor produced in the heating handle is filtered in the smoke filter for user's inhaling.

* * * * *